US006186934B1

(12) United States Patent
Addison

(10) Patent No.: US 6,186,934 B1
(45) Date of Patent: Feb. 13, 2001

(54) HANGER BAG

(76) Inventor: Todd M. Addison, 15 Classic Dr., Trumbull, CT (US) 06611

( * ) Notice: Under 35 U.S.C. 154(b), the term of this patent shall be extended for 0 days.

(21) Appl. No.: 09/521,455

(22) Filed: Mar. 8, 2000

(51) Int. Cl.[7] ..... B31B 1/86

(52) U.S. Cl. ..... 493/226; 493/225; 493/231; 493/238

(58) Field of Search ..... 493/226, 225, 493/229, 231, 232, 237, 238, 245, 255; 383/23, 22, 17, 26, 27

(56) References Cited

U.S. PATENT DOCUMENTS

| | | | |
|---|---|---|---|
| D. 321,288 | | 11/1991 | Nichol, Jr. . |
| 2,400,406 | | 5/1946 | Godoy . |
| 2,439,584 | | 4/1948 | Shumann . |
| 3,065,946 | | 11/1962 | Berkow . |
| 3,231,901 | | 2/1966 | Kennedy . |
| 3,429,498 | | 2/1969 | Dorfman . |
| 3,452,922 | | 7/1969 | Hart . |
| 3,462,068 | | 8/1969 | Suominen . |
| 3,525,468 | | 8/1970 | Kamins et al. . |
| 3,549,085 | | 12/1970 | Hart . |
| 3,670,947 | | 6/1972 | Tangredi et al. . |
| 3,672,562 | | 6/1972 | Bosse . |
| 3,693,867 | | 9/1972 | Schwarzkopf . |
| 3,695,418 | | 10/1972 | Gwozdz . |
| 3,720,036 | | 3/1973 | Armstrong . |
| 3,765,597 | | 10/1973 | Brieske . |
| 3,782,622 | | 1/1974 | Montgomery . |
| 3,836,068 | | 9/1974 | Schwarzkopf . |
| 4,084,689 | | 4/1978 | Yamagata . |
| 4,153,560 | | 5/1979 | Dinter et al. . |
| 4,298,440 | | 11/1981 | Hood . |
| 4,347,930 | | 9/1982 | Herrin . |
| 4,362,526 | | 12/1982 | Wilson . |
| 4,385,722 | | 5/1983 | Brewill . |
| 4,550,439 | | 10/1985 | Pepplatt et al. . |
| 4,590,610 | | 5/1986 | Rhyne . |
| 4,636,191 | | 1/1987 | Piggott . |
| 4,662,974 | | 5/1987 | Roberts . |
| 4,704,100 | | 11/1987 | Kaufman . |
| 4,834,553 | | 5/1989 | Bennett . |
| 4,881,932 | | 11/1989 | Blatt . |
| 4,919,262 | | 4/1990 | Kuroishi . |
| 5,009,515 | | 4/1991 | Bennett . |
| 5,014,957 | | 5/1991 | Nichol, Jr. . |
| 5,026,174 | | 6/1991 | Blatt . |
| 5,071,400 | | 12/1991 | Bennett . |
| 5,083,413 | | 1/1992 | Bennett . |
| 5,716,137 | * | 2/1998 | Meyer ..... 493/225 |
| 5,894,707 | * | 4/1999 | May ..... 493/226 |

FOREIGN PATENT DOCUMENTS

| | | |
|---|---|---|
| 0 454 521 A1 | 10/1991 | (EP) . |
| 1404575 | 5/1965 | (FR) . |
| 2 530 223 | 3/1984 | (FR) . |
| 380552 | 9/1932 | (GB) . |
| 2 074 985 | 11/1981 | (GB) . |
| 2 111 459 | 7/1983 | (GB) . |
| WO 94/01334 | 1/1994 | (WO) . |

OTHER PUBLICATIONS

"Concepts in vertical merchandising and specialty packaging", W. R. Grace & Co., 1971, 102 pages.
"Hanes pack redesign makes shopping simpler", Packaging World, Oct. 1999, p. 11.

* cited by examiner

*Primary Examiner*—Stephen F. Gerrity
*Assistant Examiner*—Sam Tawfik
(74) *Attorney, Agent, or Firm*—Perman & Green, LLP

(57) ABSTRACT

A package is formed from two sheets of thin film material which are double backed upon each other to form a header and a rigid plastic insert is connected to the header coincident with a cut out formed therein. The cut exposes an internalized J-shaped portion of the insert such that a hook can be readily inserted and maintain the bag in place on a display rack.

6 Claims, 9 Drawing Sheets

HANGER BAG

BACKGROUND OF THE INVENTION

Field of the Invention

The present invention relates to thin film plastic bags of the type having hangers which hold the bag and its contents on a supporting rod, such as found in retail display rack, and relates more particularly to an improvement in such bags wherein the hanger portion thereof has an internalized hook which connects to the supporting rod within the area of the bag defined by its side top and bottom edges to more effectively display and utilize space in a retail environment for example.

Plastic film bags having hangers of plastic are known in the industry. These hangers usually include a hook which protrudes outwardly and upwardly from the plastic film portion of the bag. A typical example of this technology can be found in the plastic bag construction disclosed in the U.S. Pat. No. 3,782,662 issued to Montgomery on Jan. 1, 1974. In this patent, it is disclosed to provide a plastic bag wherein a hem at the mouth of the bag is provided for receiving a stiffener portion extending transversely within the bag. The stiffener portion may have a hook which extends outwardly from the bag at the top or leading edge thereof. While such hooks have been an effective way of hanging bags onto hanging rods or the like, it should be understood that the use of such hooks cause the bag to undesirably occupy vertical space otherwise dedicated to the presentation of other or more like bags on the display. This reduction in size of the bag is desirable because it increases the amount of product which can be otherwise presented to a consumer at a given display. Furthermore, the heretofore use of the outwardly extending supporting hook causes an interruption in the perimeter in the bag which from a graphic standpoint is unpleasing to the eye. That is, often the top portion of the bag will carry graphics which will be cut off or drastically interrupted by the supporting hook. U.S. Pat. No. 3,782,622 further discloses in FIG. 6 an insert has a hole 47 provided in the stiffener. This hole serves in lieu of the hook, however, the use of a hole instead of a smoothly channeled receiving slot such as found in the insert of the present invention is undesirable because it causes the user additional time in aligning the opening with the rod and inserting it concentrically over it. Specifically, it requires time to place or remove a package from a display rod and also to place it at a desired location on a display rod relative to other packages or to remove it from the display rod. This is sometimes referred to as "a shoppable package".

It has also been known to use a cardboard header insert which has a internalized recessed hook formed within the stiffener connected transversely to the top end of the bag. However, such hook structures were only found in cardboard type stiffener headers which are prone to breaking off and did not present the load capability presently needed, for example, in the package of underwear or cotton stock apparel, and hanging same on a display hook. Furthermore, in order to establish the sufficient holding strength in the header even for the limited load involved, it was necessary to size the header insert to extend transversely almost entirely across the header. This presents a further problem in that the sides of the header needed to be notched out in order to effectively seal the side edges.

Accordingly, it is an object of the invention to provide an improved plastic bag with a hanger incorporated therein having a construction which provides a low cost and effective bag having a hanger which does not extend beyond the outline of the bag thereby providing the bag with a reduced effective height and uninterrupted face.

Still a further object of the invention is to provide an improved package made of plastic film or the like having an associated hanger made from plastic or the like which may be heat welded with the film thereby enabling the package to be compact and self-contained.

Still a further object of the invention is to provide an improved package of the aforementioned type having an internalized hanger which provides a fixed and unvarying relationship between packages of like fabrication.

Still a further object of the invention is to provide an improved method of assembling a hanger within a thin film package.

Still yet a further object of the invention is to provide a package which provides high strength and allows the package to be printed on up to its top edge.

Other objects and advantages will become apparent from the appended claims and the following specification.

SUMMARY OF THE INVENTION

The invention resides in an improved package made from thin film plastic having a hanger part formed from plastic and which hanger part has an internally profiled hook which is dimensioned so as to receive a connecting or hanging rod within the perimeter of the package making the package more compact and uninterrupted.

That is, the invention resides in a package comprising: a bag part defined by a first wall and a second wall connected along side edges thereof to define an internal compartment therein; the first and second walls further defining a header portion ending in a leading edge of the package; the leading edge of the package has a cut extending inwardly into the header portion toward the compartment; an insert part is located within the header and is secured against movement to the header portion and has an opening formed therein located generally coincidentally with the cut in the header; and wherein the insert is made from a rigid plastic blank and the first and second walls are made of thin film plastic material and according to which at least one of the walls may be heat welded to the insert.

More specifically, the package comprises a bag part defined by a first wall and a second wall connected along side edges thereof to define an internal compartment therein; the first and second walls further defining a header portion ending in a leading edge of the package; the leading edge of the package has a cut extending inwardly into the header portion toward the compartment; an insert part is located within the header and is secured against movement to the header portion and has an opening formed therein located generally coincidentally with the cut in the header; the first and second walls may be opposed separate webs of sheet material or may be portions of a single web of sheet material folded back on itself and the leading edge of the package is the folded back portion of the single web; wherein the insert is made from a rigid plastic blank and the first and second walls are made of thin film plastic material and at least one of which walls may be heat welded to the insert.

The invention also resides in a method of forming a package comprising: providing a web of thin film plastic material; folding the web of the thin film plastic material transversely of its length to create a header; cutting an opening in the double back web of the thin material into the folding line thereof; inserting a plastic insert with an internally formed opening between the doubled back web pieces; and securing the insert against movement in said header.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
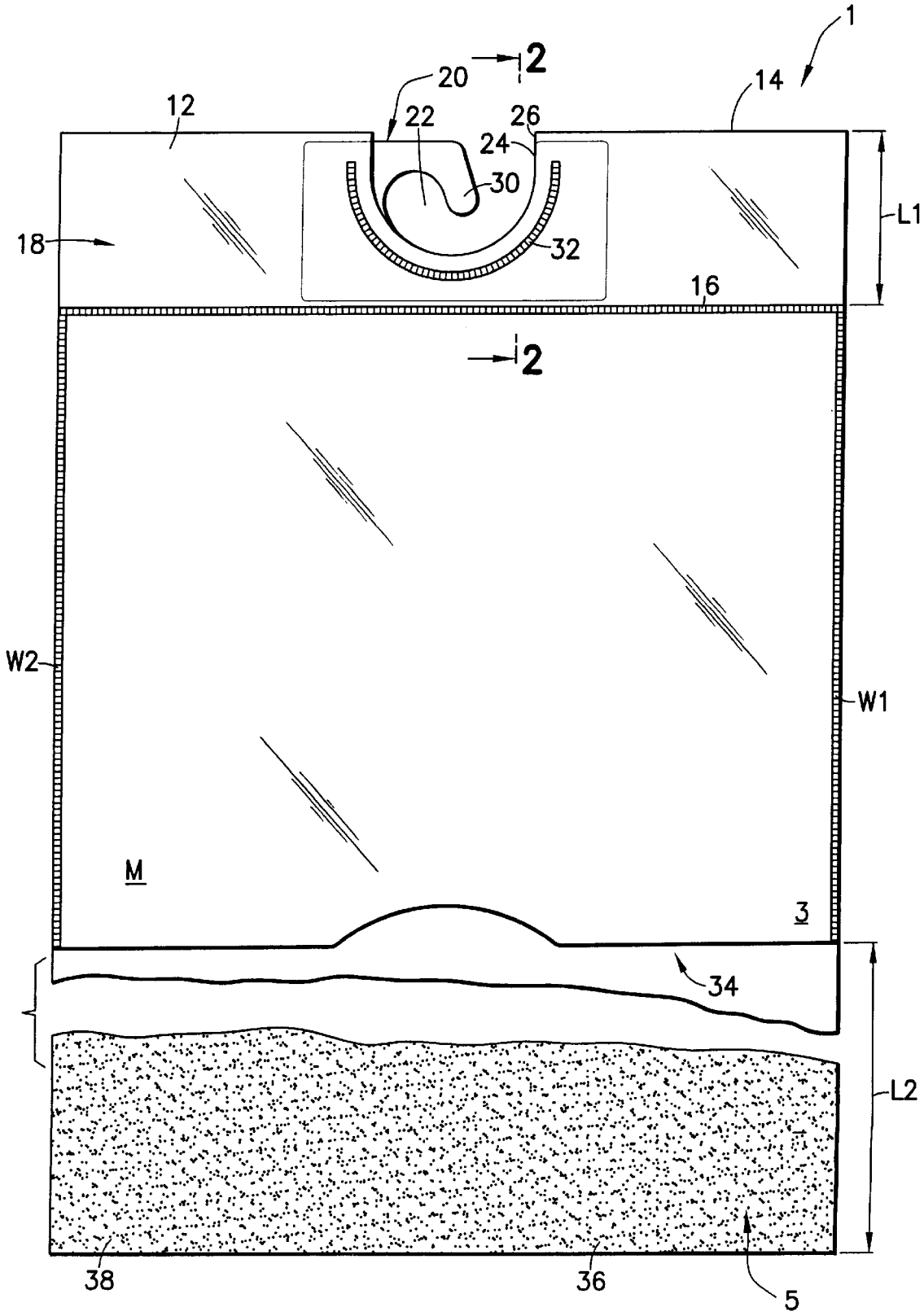
FIG. 1 is a partially fragmentary plan view of the package of the present invention.

FIG. 1 shows generally a package indicated by reference numeral 1 embodying the present invention. The package 1 has a bag part 2 and a hanger part 20, the bag part is made from thin film flexible heat sealable sheet material M, such as polyethylene or polypropylene, having front and back walls 3, 5 joined at the side edges thereof by a heat seal weld respectively shown for each side as W1 and W2 of the bag 2.

As seen in FIG. 1, the package 1 has at the topmost end, a leading edge 14 which is defined by a doubled back length of the thin film bag material M. This leading edge further defines in part a header portion 18 having an internal laterally extending pocket 12. That is, the pocket 12 at its topmost end is formed by the doubled back length of the flexible heat sealable sheet material M, and at a distance L1 is further defined by a laterally extending heat weld 16 which extends laterally across the transverse face of each of the sidewalls 3 and 5 and meets with the side edge welds W1 and W2. Thus, as between the top double backed leading edge 14 and the transverse weld 16 a space or confine 18 is provided. The space or header 18 is correspondingly sized and shaped to receive the generally rectangular shape of the hanger 20 therein. The hanger insert 20 is formed from rigid flat plastic piece and has a generally J-shaped slot 22 formed in it opening to a semi-circular cutout 24 cut through both plies of the material M and opening to the leading edge 14 at the top edge thereof. The insert is made in the color of the graphic printed on header 18 to better blend with it.

As will be discussed in greater detail later, the J-haped slot 22 in the hanger 20 is designed so as to readily receive a rack rod which would be found normally in a display environment in a retail establishment such that the package can be readily hung on the rod and be taken off of the rack rod by a simple manipulation of movement. The J-shaped slot 22 is located coincidentally with the generally semi-circular cutout 24 which is cut into the two sidewalls 3 and 5 of the bag. As mentioned, the cut 24 also permeates the double back leading edge 14 thereby exposing the middle band of the pocket 12 to the internally disposed hanger insert 20 located within the pocket 12.

As illustrated, the cut 24 has a generally semi-circular form as illustrated such that the bottom arc of the cut 26 is coincident with the curvature of the bottom of the J-shaped slot thereby minimally exposing the hanger insert. This is important in that it maintains as much as possible a non-interrupted face in the top portion of the bag so as to give a greater continuing appearance to it.

As illustrated, the insert 20 has a hook portion 30 which is defined by the J-shaped slot 22 and extends into the cut 24 made in the bag material M in the manner illustrated. The hook portion 30 is preferably of the same color as that of the header portion of the bag 1, which usually contains graphics and logos concerning the product and/or its manufacturer. Thus, the interruption in color caused by the cut 24 in the header 12 may be minimized by a similarly coloring the hook portion 30 with that of the header color.

Figure 2:
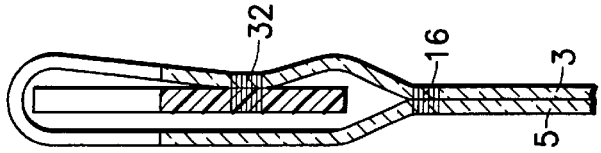
FIG. 2 is a partially fragmentary vertical elevation view taken along line 2—2 in FIG. 1.

As illustrated in FIG. 1 and in FIG. 2, the insert 20 is maintained within the pocket 12 in the in the position illustrated in FIG. 1 through the intermediary of a heat weld 32, preferably arcuate, which is formed between one or both of the layers 3 and 5 and the insert 20. The heat weld 32 may be made directly into the insert 20 thereby holding and fixing the position of the insert relative to the bag. This maintains the relative position of the insert and the bag without need of mechanical or other fastenings or other like positioning means.

Figure 1A:
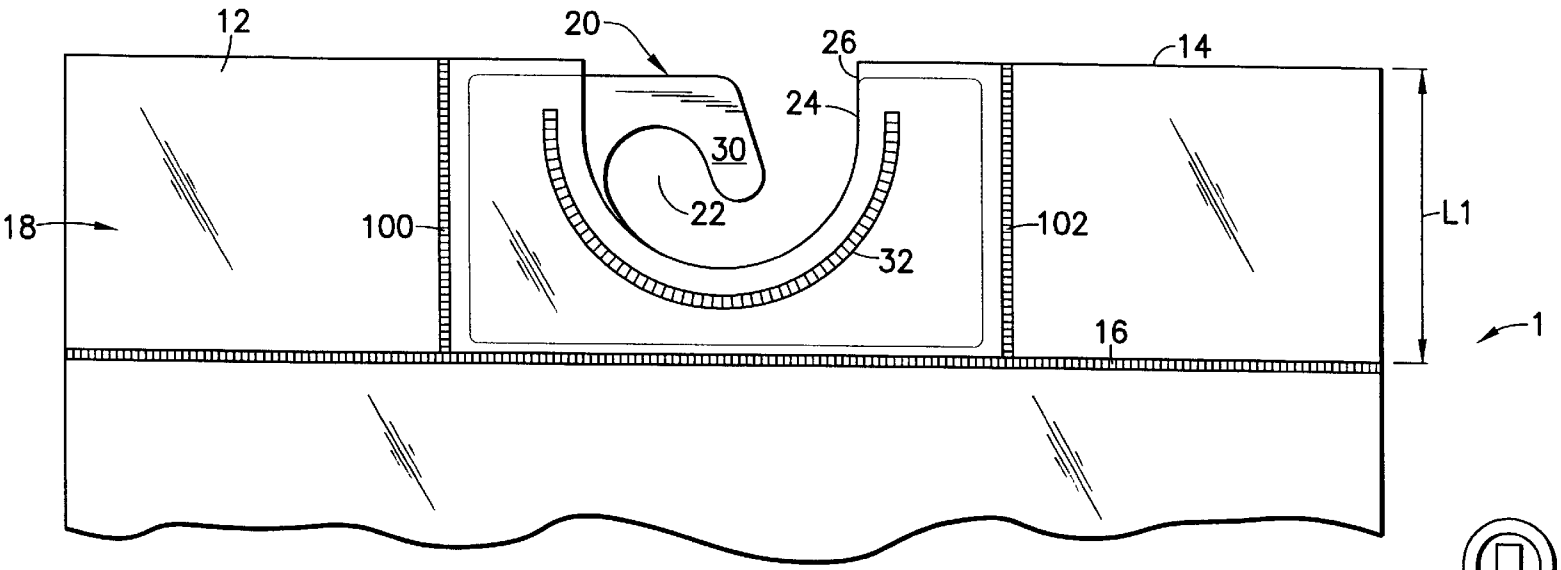
FIG. 1A is a detail plan view, similar to a part of FIG. 1, illustrating another embodiment of the invention.

In another instance, viewing FIG. 1A, the front and back walls 3, 5 may be mutually heat welded as at 100, 102 which, together with heat weld 16, form a pocket 104 snugly containing the insert 20 and restraining it against substantial movement.

As illustrated in FIG. 1, the wall 5 has a length which exceeds that of the wall 3 by the dimension illustrated as L2. This length L2 is provided such that an opening 34 exists between the walls 3 and 5 thereby allowing product to be stuffed within a pocket formed by the side welds W1 W2 and a transversely extending weld 16. As is typical in the industry, the end portion of the flap 36 may have a film of releasable adhesive 38 allowing the flap to be upturned and sealed into place onto the outer surface of the outer wall 3 upon stuffing of the product into the pocket.

Figure 4:
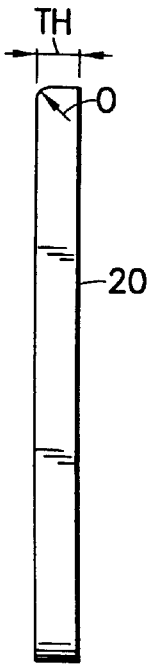
FIG. 4 is a side elevation view of the hanger of FIG. 3.
Figure 3:
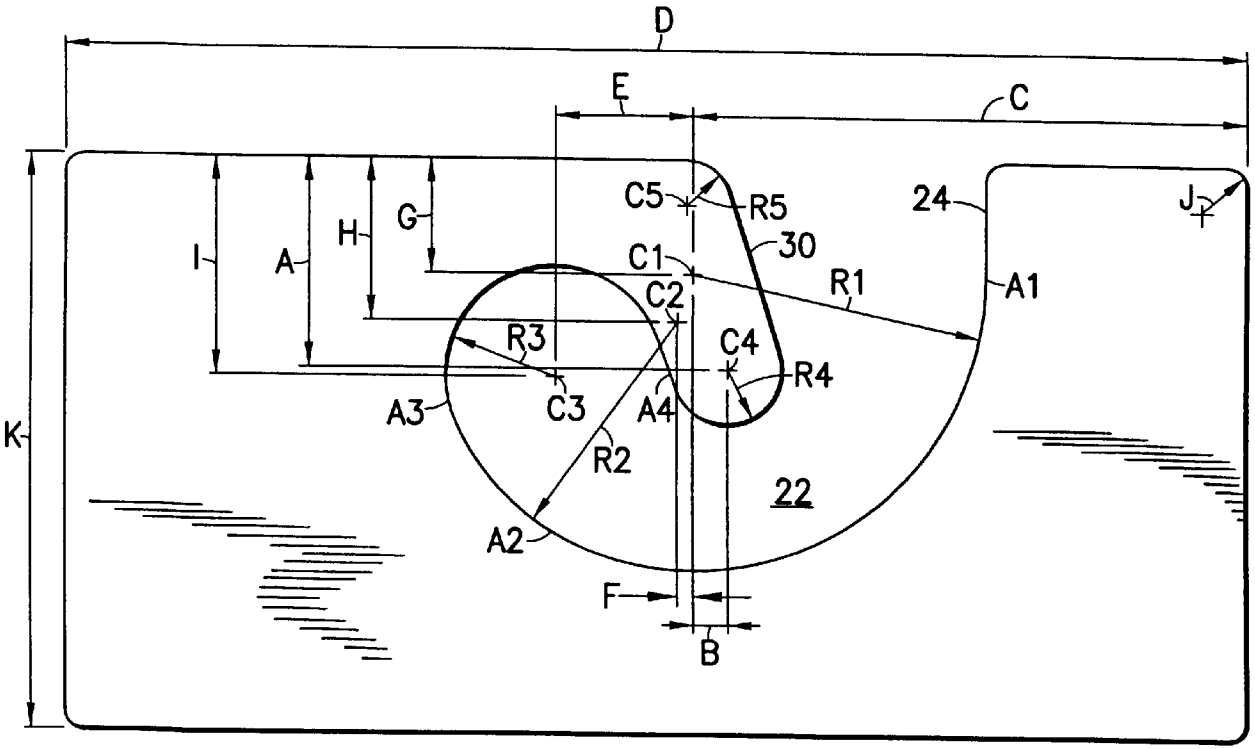
FIG. 3 is a top plan view showing the hanger apart from the bag.

Referring now to FIGS. 3 and 4, it should be seen that the insert 20 has an internally formed J-shaped slot 22 with an outwardly tapered mouth 24 opening coincidentally with the top leading edge 14 of the bag. The tapered mouth 24 is designed to facilitate easy guidance onto a rack rod which may have a nominal diameter on the order of 0.250 inches, or thereabouts, depending on the application. In any event, the J-shaped slot 22 is designed such that regardless of the diameter of the mounting rod used, ease of hanging of the bag and subsequent removal can be effected by both the stocker and the customer, respectively.

To these ends, it should be seen that from a review of the slot 22 formed in the insert 20 that along given points the shape of the arc changes to accommodate various functions involved in the use of the hanger. That is, along the segment from point A1 to point A2, the J-shaped slot 22 has a generally constant radius R1 equaling approximately 0.515 inches taken from the theoretical center C1. At point A2, a second curvature is provided between points A2 and points A3 which is equal to a radius of 0.437 inches taken from the theoretical center C2. Between points A3 and A4 is a third radius R3 taken from the theoretical center C3 having a radius of 0.195 inch. This radius provides an enlarged receiving area for the rack rod to support the bag and be removed without jamming. The radius R3 ends at point A4 and another radius R4 having a theoretical center at C4 is provided to define the tip of the hanger wherein a straight line 30 angled upwardly at approximately 18° to the vertical is made. The angular cut along with a fifth radius R5 of 0.062 inch measured from theoretical center C5 defines the tapered mouth 24 and allows for insertion of the bag into place. The insert also has a thickness TH of approximately 0.063 inches allowing it to provide sufficient thickness to receive and hold the weld 14 and to support between 12 and 14 ounces of product which can range from socks to underwear. The below table illustrates further dimensions which are not otherwise taken into discussion.

Dimensions are all in inches
A=0.369
B=0.058
C=0.993
D=2.125
E=0.25
F=0.028
G=0.200
H=0.278
I=0.375
J=0.031
K=1.00
L=0.406
M=0.031
N=0.437
O=0.016

Figure 5A:
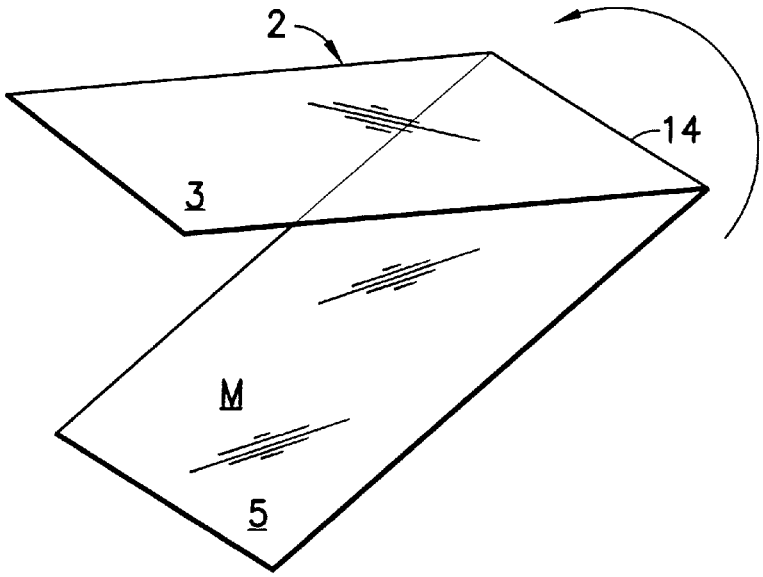
FIGS. 5A–5D show schematically the fabrication process for the bag of FIG. 1.
Figure 5B:
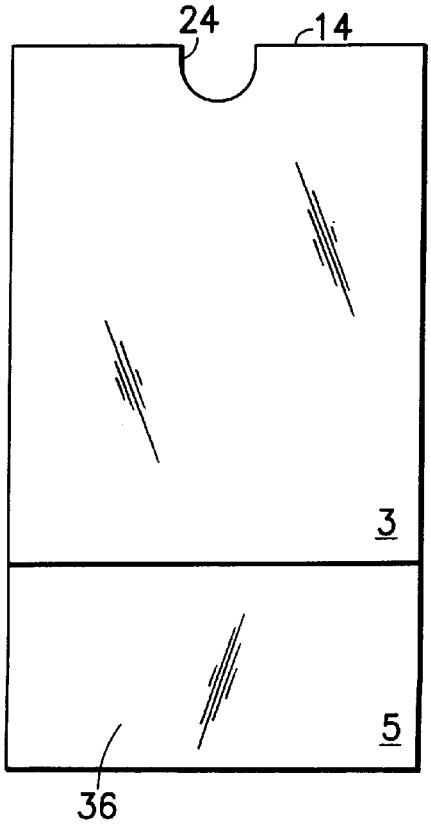
Figure 5D:
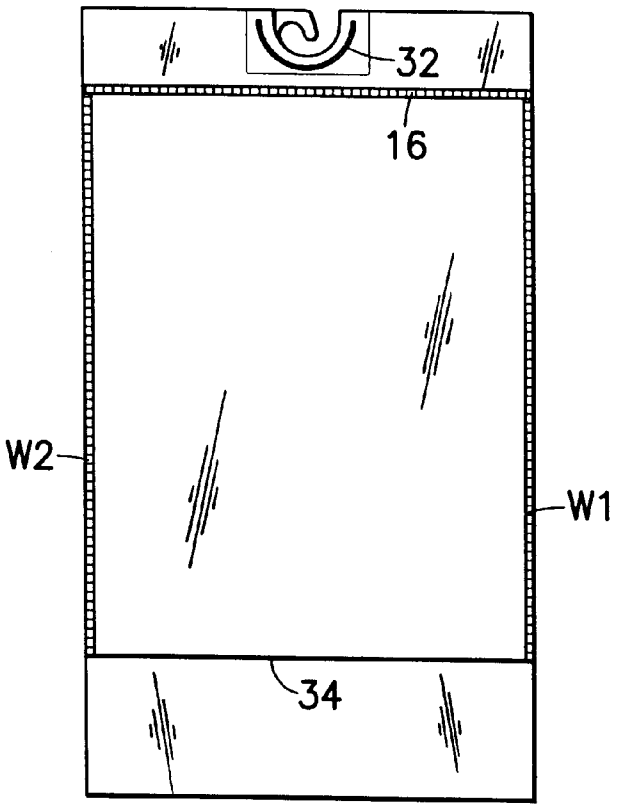
Figure 5C:
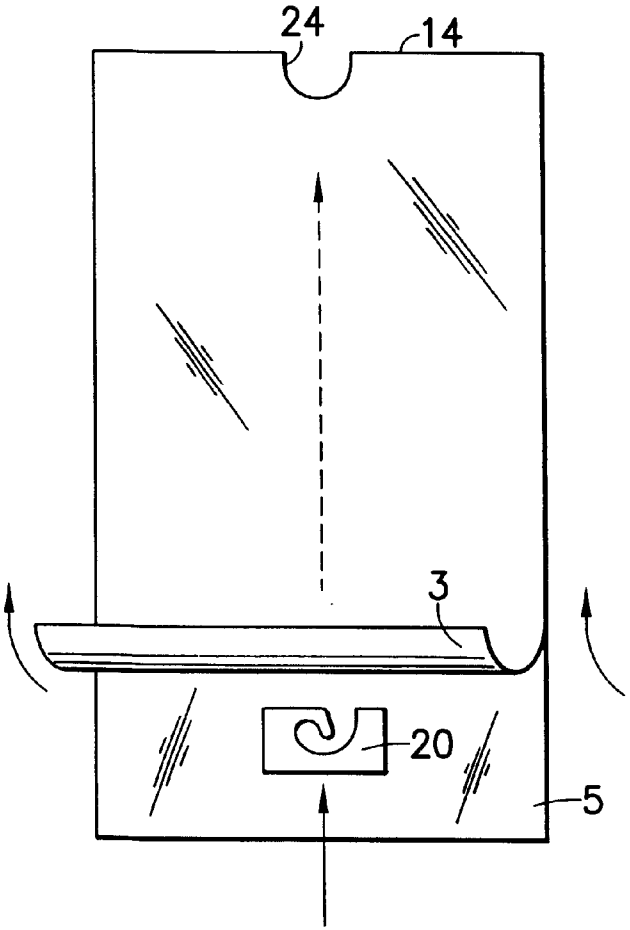
Figure 6A:
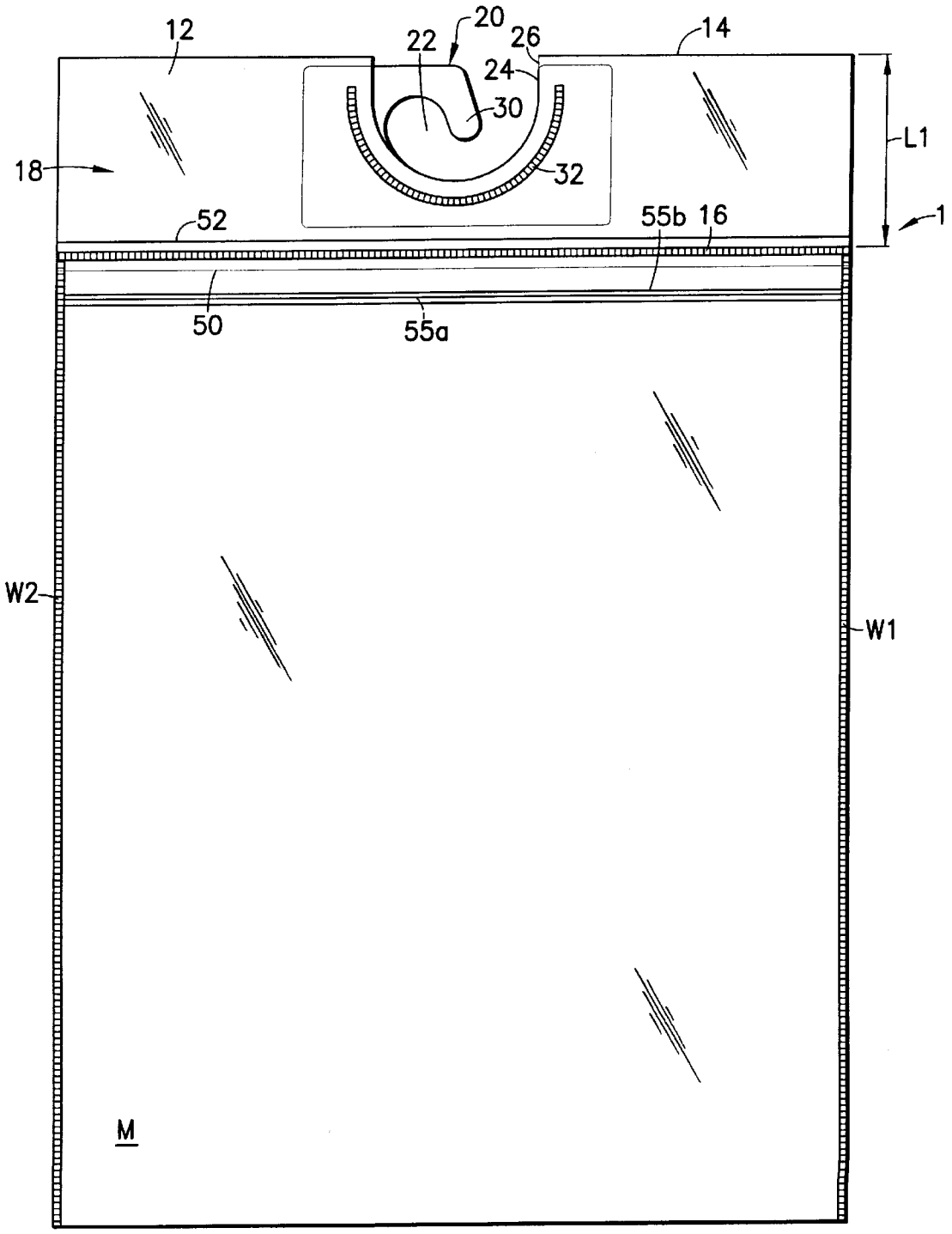
FIGS. 6A–6D show an alternative embodiment and show schematically the fabrication process for the bag of FIG. 6A.
Figure 6B:
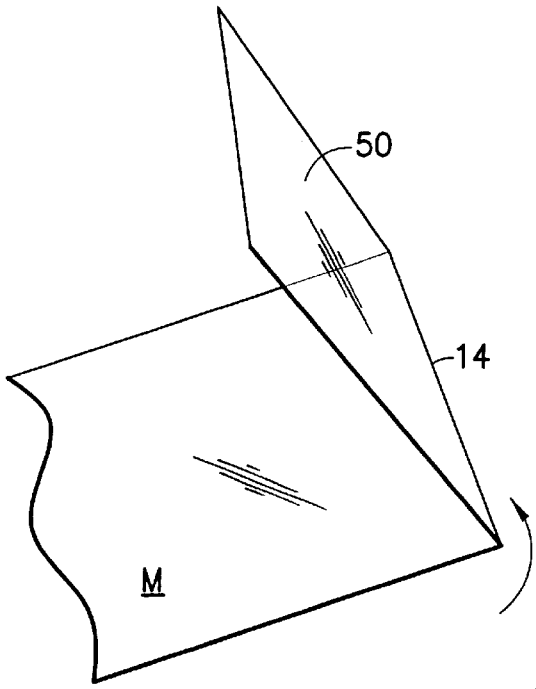
Figure 6C:
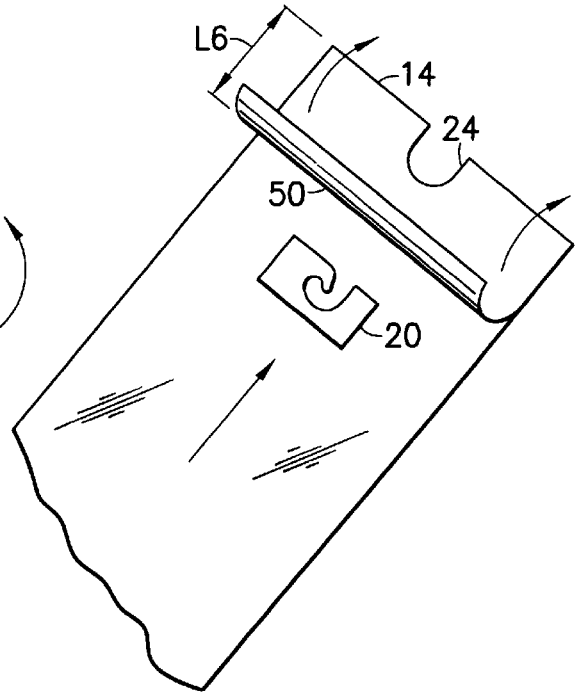
Figure 6D:
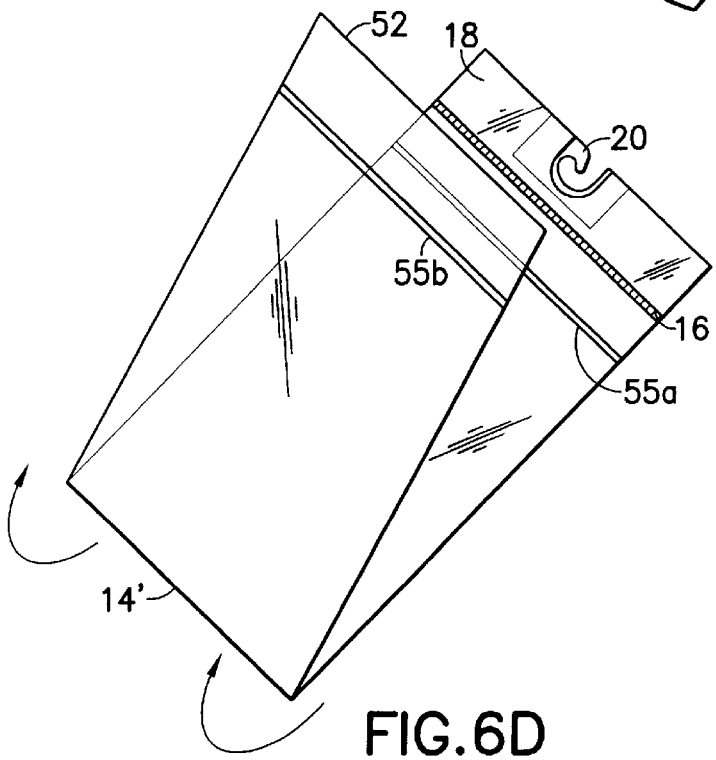
Figure 7A:
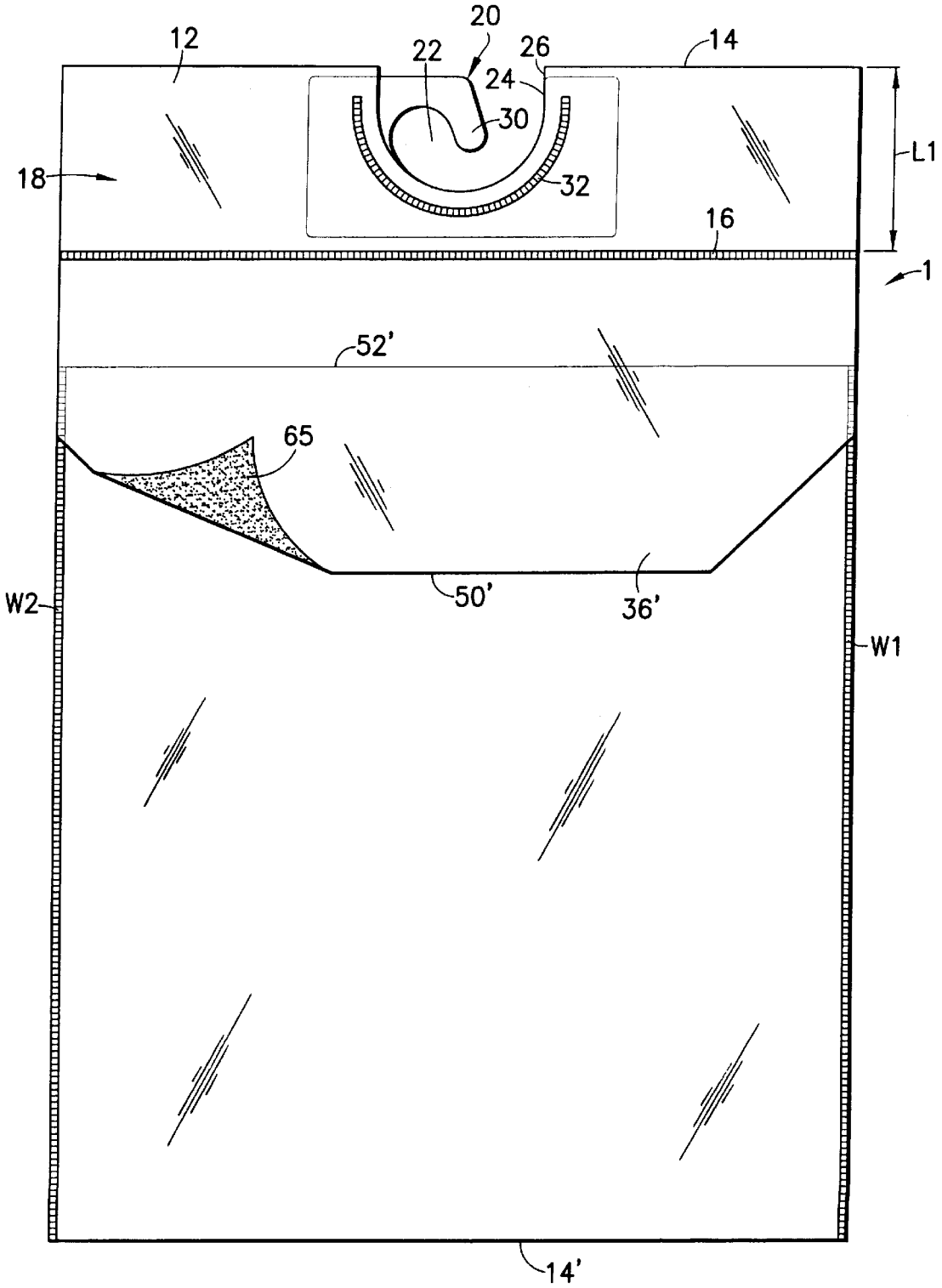
FIGS. 7A–7D show an alternative embodiment and show schematically the fabrication process for the bag of FIG. 7A.
Figure 7B:
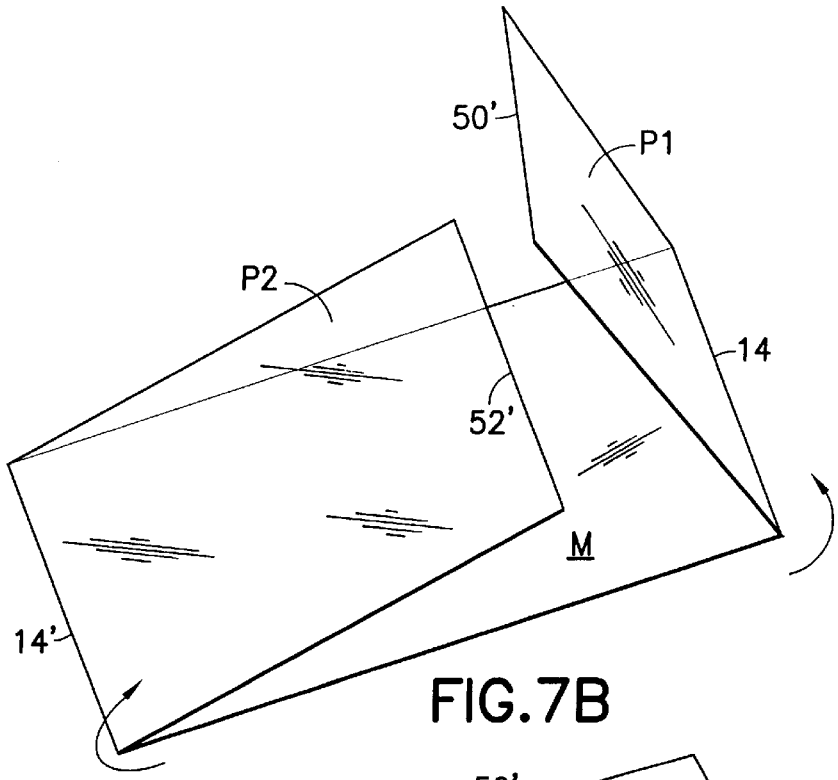
Figure 7C:
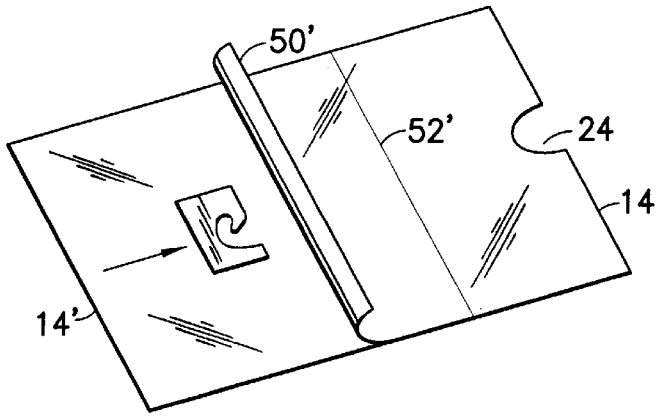
Figure 7D:
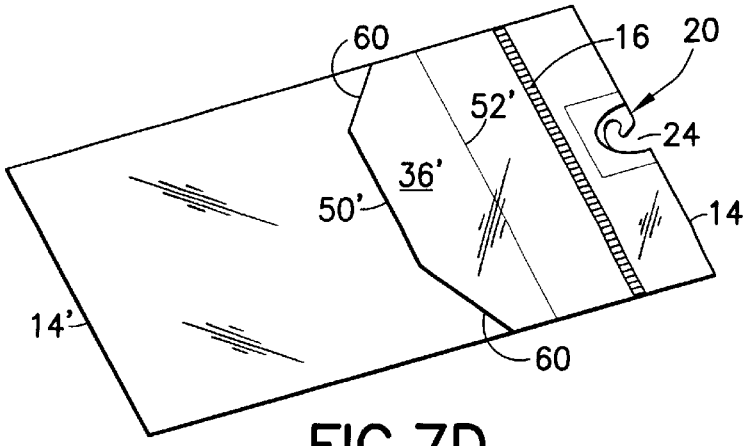

Referring now to FIGS. 5A–5C it should be seen that the method by which the package 1 illustrated in FIG. 1 is made is shown. As seen in FIG. 5A, a single sheet or web of thin film plastic material is folded along itself along transverse fold line 14 which ultimately constitutes the leading top edge of the bag. The fold line 14 also defines the front and rear walls 3 and 5, respectively, of the bag with the length of the rear wall 5 being selected to be shorter than ply 5 by the length L2, such that the dimension L2 provides the flap 36 herein discussed above.

After the fold line 14 is made, the semi-circular cut 26 is formed through the top edge 14 proximate the center of the bag. Thereafter, the two plies are separated from one another enough to allow the insert 20 to be slid upwardly toward the leading edge 14 so as to position it in the location shown in FIG. 1, that is, such that the generally J-shaped slot is lined up coincidentally with the cut out 24 and the bottom curvatures of both the slot and the cut out are aligned with one another as seen in FIG. 1.

With the insert 20 in place, welds are made on the film material M. Weld 16 is provided transversely along the top portion of the bag as mentioned and welds W1 and W2 are made along the longitudinal edges thereof. Either before or after these welds are in place or in combination therewith, the connecting weld 32 may be made between one or both the plies 3 and 5 of the film material M to immovably connect the bag part 2 to the insert 20.

Referring now to FIG. 6A–6D, a second embodiment of the invention is shown. In this embodiment, a single sheet of web has upper and lower doubled back portions 14, 14', the upper of which portion forms the header 18 and connects the insert 20 to the package 1 in a manner similar to that discussed above with respect to FIGS. 5A–5D. That is, the top edge of the package 1 is formed by a fold line 14 which in turn forms the pocket 18 by the doubled back portion of the web M. In the present embodiment, the doubled back portion identified by the dimension L6 is cut to form a free end 50 which is sealed to the opposing sheet by the transverse weld 16. Since the bottom of the bag part is closed the other fold line 14', only welds W1 and W2 need be made in order to effect the bag compartment. The opposite free end 52 of the web M forming the bag pocket is let without a weld, but is provided with a releasable sealing device, such as, a zip lock type seal 55*a*, 55*b* each of which part is welded to one of the free edge 52 portion and the opposite surface of the web M.

Referring now to FIG. 7A–7D, a third embodiment of the invention is shown. In this embodiment, a single sheet of web has upper and lower doubled back portions 14, 14', the upper of which portion forms the header 18 and connects the insert 20 to the package 1 in a manner similar to that discussed above with respect to FIGS. 5A–C. That is, the top edge of the package 1 is formed by a fold line 14 which in turn forms the pocket 18 by the doubled back portion of the web M. In the present embodiment, the doubled back portion identified by the dimension L6 is cut to form a free end 50 which is sealed to the opposing sheet by the transverse weld 16. The fold 14' creates a panel portion P2 over which is folded panel portion P1 created by the fold line 14. The panel P1 is of a length that it extends beyond the transverse weld 16 and is cut at 60 so as to create a flap which is subsequently cut to create the flap 36'. Since the bottom of the bag part is closed the other fold line 14', only welds W1 and W2 need be made in order to effect the bag compartment. The opposite free end 52 of the web M forming the bag pocket is let without a weld, and the flap 36' may be adhesively attached to it at 65.

It should be understood that the foregoing description is only illustrative of the invention. Various alternatives and modifications can be devised by those skilled in the art without departing from the invention. The insert 20 need not be welded directly to the web or film wall(s), but rather the two plies making up the header could themselves be weld together around the insert to secure it against movement therein. Accordingly, the present invention is intended to embrace all such alternatives, modifications and variances which fall within the scope of the appended claims.

What is claimed is:

1. A method of forming a package comprising:

providing a web of thin film plastic material;

folding said web of said thin film plastic material transversely of its length;

cutting an opening in the double back web of said thin material into the folding line thereof;

inserting an internal profile plastic insert with an internally formed J-shaped slot between said double back web pieces coincident with the opening cut into the folding line of the double back web and such that said insert does not project beyond the folding line in a direction away from the doubled back web pieces; and securing said insert against movement to said header.

2. A method as defined in claim 1 further characterized by heat welding each side edge of said double back ply to one another to form an internalized compartment therein.

3. A method as defined in claim 1 further characterized by welding the double back plies of sheet material to one another transversely along the length thereof at a location just below the location of said insert.

4. A method as defined in claim 1 further characterized by folding said length of web such that the length of one folded back piece is longer than that of the other.

5. A method as defined in claim 1 further characterized by providing said cut in said leading edge of said doubled back thin film material such that said cut has a curvature which is coincident with a curvature in said opening on said insert.

6. A method as defined in claim 5 further characterized by providing said internalized J-shaped slot in said insert with a curvature coincident with said cut opening.

* * * * *

US006186934C1

(12) REEXAMINATION CERTIFICATE (4621st)

United States Patent

Addison

(10) Number: US 6,186,934 C1

(45) Certificate Issued: Jul. 23, 2002

(54) HANGER BAG

(75) Inventor: Todd M. Addison, 15 Classic Dr., Trumbull, CT (US) 06611

(73) Assignee: Todd M. Addison, Trumbull, CT (US)

Reexamination Request:
No. 90/006,060, Jul. 12, 2001

Reexamination Certificate for:

| | |
|---|---|
| Patent No.: | **6,186,934** |
| Issued: | **Feb. 13, 2001** |
| Appl. No.: | **09/521,455** |
| Filed: | **Mar. 8, 2000** |

(51) Int. Cl.[7] ..... B31B 1/86

(52) U.S. Cl. ..... 493/226; 493/225; 493/231; 493/238

(58) Field of Search ..... 493/225, 226, 493/231, 238

(56) References Cited

U.S. PATENT DOCUMENTS

| | | | |
|---|---|---|---|
| 4,832,537 | A | 5/1989 | Bennett |
| 4,834,553 | A | 5/1989 | Bennett |
| 4,854,931 | A | 8/1989 | Roberts et al. |

FOREIGN PATENT DOCUMENTS

| | | |
|---|---|---|
| JP | 176520 | 12/1979 |
| JP | 187505 | 10/1984 |
| JP | 223655 | 8/1995 |

OTHER PUBLICATIONS

Japanese text of Japan Patent 187505.

Japanese text of Japan Patent 223655.

Japanese text of Japan Patent 176520.

*Primary Examiner*—Eugene L Kim

(57) ABSTRACT

A package is formed from two sheets of thin film material which are double backed upon each other to form a header and a rigid plastic insert is connected to the header coincident with a cut out formed therein. The cut exposes an internalized J-shaped portion of the insert such that a hook can be readily inserted and maintain the bag in place on a display rack.

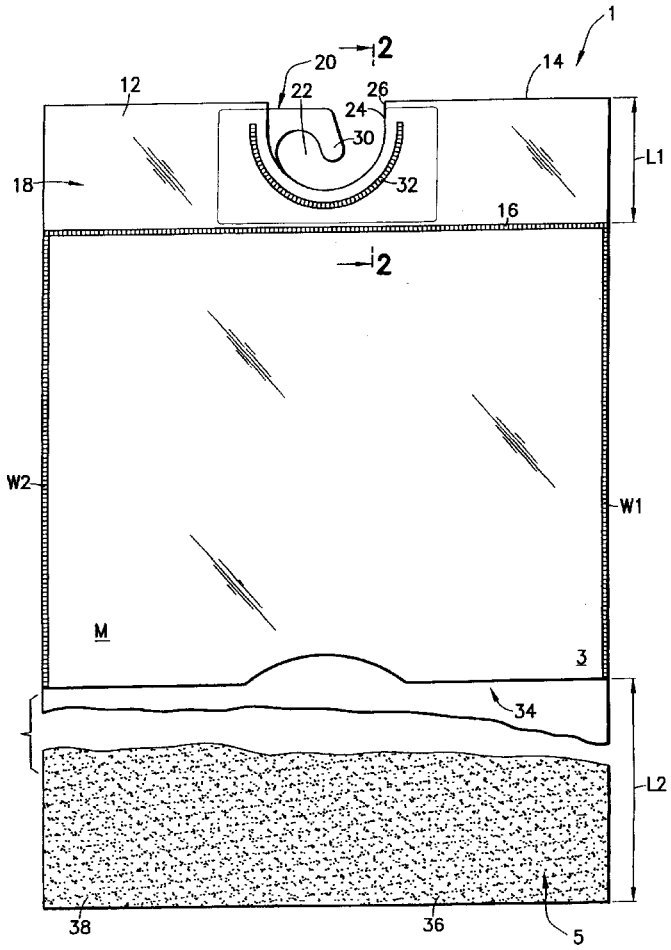

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–6 is confirmed.

* * * * *